US010637169B2

(12) United States Patent
Fan et al.

(10) Patent No.: US 10,637,169 B2
(45) Date of Patent: Apr. 28, 2020

(54) MINIATURIZED HIGH-SPEED PLUG-IN CARD TYPE CONNECTOR

(71) Applicant: Amphenol Commercial Products (ChengDu) Co. LTD, Chengdu (CN)

(72) Inventors: Jun Fan, Suining (CN); Rongzhe Guo, Chengdu (CN)

(73) Assignee: AMPHENOL COMMERCIAL PRODUCTS (CHENGDU) CO. LTD, Chengdu (CN)

( * ) Notice: Subject to any disclaimer, the term of this patent is extended or adjusted under 35 U.S.C. 154(b) by 0 days.

(21) Appl. No.: 15/878,426

(22) Filed: Jan. 24, 2018

(65) Prior Publication Data

US 2019/0006778 A1 Jan. 3, 2019

(30) Foreign Application Priority Data

Jun. 28, 2017 (CN) ..... 2017 2 07615379 U
Sep. 12, 2017 (CN) ..... 2017 2 11594303 U

(51) Int. Cl.

| | |
|---|---|
| ***H01R 12/72*** | (2011.01) |
| ***H01R 13/422*** | (2006.01) |
| ***H01R 13/50*** | (2006.01) |
| ***H01R 13/6461*** | (2011.01) |
| ***H01R 13/26*** | (2006.01) |
| ***H01R 12/71*** | (2011.01) |
| ***H01R 13/6474*** | (2011.01) |

(52) U.S. Cl.

CPC ..... *H01R 12/721* (2013.01); *H01R 12/716* (2013.01); *H01R 13/26* (2013.01); *H01R 13/422* (2013.01); *H01R 13/50* (2013.01); *H01R 13/6461* (2013.01); *H01R 13/6474* (2013.01)

(58) Field of Classification Search

CPC .... H01R 12/72; H01R 12/721; H01R 13/422; H01R 13/50; H01R 13/6461

See application file for complete search history.

(56) References Cited

U.S. PATENT DOCUMENTS 3,861,775 A * 1/1975 Makins ..... H01R 12/721 439/59
3,910,663 A * 10/1975 Winger ..... H01R 4/64 439/92
4,262,981 A * 4/1981 Goodman ..... H01R 12/721 439/62
5,156,554 A * 10/1992 Rudoy ..... H01R 13/6471 439/108
5,192,232 A * 3/1993 Lenz ..... H01R 12/52 439/660
5,259,793 A * 11/1993 Yamada ..... H01R 12/721 439/637

(Continued)

*Primary Examiner* — Oscar C Jimenez

(74) *Attorney, Agent, or Firm* — Bayramoglu Law Offices LLC

(57) ABSTRACT

A miniaturized high-speed plug-in card type connector, including a plastic shell. Two rows of signal terminals, which are arranged in a staggered manner, are arranged in the plastic shell. Where in the two rows of signal terminals are arranged in a staggered manner. The distance between the two adjacent signal terminals in the same row is 0.62-0.68 mm. Each signal terminal includes a terminal body and a head end connected as a whole with the terminal body, and a thickness of the head end is smaller than a thickness of the terminal body.

9 Claims, 5 Drawing Sheets

(56) References Cited

U.S. PATENT DOCUMENTS 5,259,795 A * 11/1993 Yamada ..... H01R 12/721 439/637
5,425,658 A * 6/1995 White ..... H01R 23/6873 439/60
5,433,616 A * 7/1995 Walden ..... H01R 12/721 439/62
5,536,179 A * 7/1996 Olsson ..... H01R 23/688 439/108
5,697,799 A * 12/1997 Consoli ..... H01R 12/716 439/181
5,919,064 A * 7/1999 Petersen ..... H01R 43/16 439/637
5,921,787 A * 7/1999 Pope ..... H01R 12/85 439/660
6,000,950 A * 12/1999 Kajinuma ..... H01R 12/57 439/60
6,053,757 A * 4/2000 Turnbull ..... H01R 12/721 439/326
6,439,928 B1 * 8/2002 Akama ..... H01R 13/6585 439/607.09
6,645,005 B2 * 11/2003 Wu ..... H01R 12/707 439/563
7,544,067 B1 * 6/2009 Hatano ..... H01R 13/2442 439/660
9,281,590 B1 * 3/2016 Liu ..... H01R 12/707
9,972,945 B1 * 5/2018 Huang ..... H01R 13/6585
10,020,603 B1 * 7/2018 Liu ..... H01R 12/7088
10,224,664 B2 * 3/2019 Kitajima ..... H01R 12/716
2001/0012735 A1 * 8/2001 David ..... H01R 13/5045 439/701
2003/0186590 A1 * 10/2003 Nishiyama ..... H01R 12/7005 439/637
2005/0101190 A1 * 5/2005 Ong ..... H01R 12/57 439/637
2006/0009080 A1 * 1/2006 Regnier ..... H01R 12/725 439/637
2006/0014438 A1 * 1/2006 Regnier ..... H01R 13/41 439/637
2007/0010125 A1 * 1/2007 Regnier ..... H01R 13/26 439/495
2010/0068939 A1 * 3/2010 Xu ..... H01R 13/6471 439/651
2011/0230101 A1 * 9/2011 Tang ..... H01R 13/6461 439/638
2011/0248135 A1 * 10/2011 Sakamoto ..... H01R 12/707 248/224.8
2013/0115814 A1 * 5/2013 Briant ..... H01R 12/716 439/607.08
2014/0030927 A1 * 1/2014 Chen ..... H01R 12/00 439/629
2014/0162499 A1 * 6/2014 Goh ..... H01R 13/6461 439/630
2014/0242845 A1 * 8/2014 Miki ..... H01R 24/66 439/629
2014/0357105 A1 * 12/2014 Wig ..... H05K 1/0216 439/81
2016/0190746 A1 * 6/2016 Goh ..... H01R 13/6471 439/626
2017/0179626 A1 * 6/2017 Hori ..... H01R 12/712
2017/0358880 A1 * 12/2017 Zeng ..... H01R 12/721

* cited by examiner

MINIATURIZED HIGH-SPEED PLUG-IN CARD TYPE CONNECTOR

CROSS REFERENCE TO RELATED APPLICATIONS

This application is based upon and claims priority to Chinese Patent Application No. 2017207615379, filed on Jun. 28, 2017 and Chinese Patent Application No. 2017211594303 filed on Sep. 12, 2017, the entire contents of which are incorporated herein by reference.

TECHNICAL FIELD

The present invention relates to the technical field of communication, and particularly relates to a miniaturized high-speed plug-in card type connector.

BACKGROUND OF THE INVENTION

In order to carry the electronic products, it is desirable for the electronic products to be made portable. A partial volume of the electronic product can be optimized by adjusting the mounting distances among internal components. However, for connectors in which signal transmission or power supply transmission is performed, their structures themselves are small. If the structures are further reduced, large crosstalk may be caused during signal transmission, which is counterproductive. Thus, the miniaturized design of the connectors causes some trouble to the miniaturization of the electronic products.

SUMMARY OF THE INVENTION

In view of the above-discussed deficiencies of the prior art, the present invention provides a miniaturization high-speed plug-in card type connector, which can ensure normal signal transmission while the volume of the connector is reduced.

To fulfill the above objective, the present invention adopts the below technical solutions.

A miniaturized high-speed plug-in card type connector is provided, including a plastic shell. Two rows of signal terminals, which are arranged in a staggered manner, are arranged in the plastic shell. The distance between the two adjacent signal terminals in the same row is 0.62-0.68 mm.

Further, each signal terminal includes a terminal body, and a head end connected as a whole with the terminal body, and a thickness of the head end is smaller than a thickness of the terminal body.

Further, the plastic shell is formed integrally with the two rows of signal terminals by an injection molding mode.

Further, the plastic shell is provided with a terminal clamping groove extending through a bottom of the plastic shell, and the signal terminals are installed in the terminal clamping groove.

Further, the terminal body includes an extending portion, a connecting portion, a plane portion and an arc-shaped portion, wherein the extending portion, the connecting portion, the plane portion and the arc-shaped portion are integrally connected, wherein the extending portion is located outside the terminal clamping groove, and an included angle is formed between the connecting portion and the extending portion.

Further, the connecting portion is substantially perpendicular to the extending portion.

Further, arc-shaped grooves are respectively formed on the two sides of the connecting portion.

Further, two ends of the plastic shell are each provided with a clamping groove, and a fixing terminal is installed in the clamping groove.

Further, the fixing terminal and the clamping groove are both T-shaped. A connecting hole is formed in a vertical plate of the fixed terminal, and the connecting hole is located outside the clamping groove.

Further, at least one guide column is arranged at the bottom of the plastic shell.

Advantages of the present invention are provided below. According to the solutions, the spacing between two adjacent signal terminals in the same row is reduced from previously 0.8 mm to the range of 0.62-0.68 mm, so that the length of the connector is greatly reduced to achieve the miniaturization of the connector. While the volume of the entire connector is reduced, the signal terminals are arranged in a staggered manner, so that the original two opposite rows of signal terminals are staggered by a certain distance. Accordingly, the spacing between the two opposite rows of terminals is increased to improve the SI performance of connector, further reducing the signal crosstalk.

In figures: 1. plastic housing; 11. clamping groove; 12. terminal clamping groove; 13. connecting plate; 14. guide column; 2. fixing terminal; 21. connecting hole; 3. signal terminal; 31. extending portion; 32. connecting portion; 33. plane portion; 34. arc-shaped portion 35. terminal body; 36. head end.

DETAILED DESCRIPTION OF THE INVENTION

The embodiments of the present invention are described below, so that the person skilled in the art can understand the present invention. However, it should be clear that the present invention is not limited to the scope of the specific embodiments. For the persons skilled in the art, so long as various changes are within the spirit and scope of the present invention as defined and determined by the appended claims, these changes are obvious. All the inventions utilizing the inventive concepts of the present invention fall into the protection scope of the present invention.

As shown in FIGS. 1-6, the miniaturized high-speed plug-in card type connector includes a plastic shell 1. Two rows of signal terminals 3 which are arranged in a staggered manner are arranged in the plastic shell 1. where in the two rows of signal terminals 3 are arranged in a staggered manner. The signal terminals 3 are arranged in a staggered mode. Therefore, the distance between two rows of opposite terminals can be increased, so that the SI performance of the connector is improved.

The distance between two adjacent signal terminals 3 in the same row is 0.62-0.68 mm. According to the technical solution, the distance between every two adjacent signal terminals 3 is reduced from previously 0.8 mm to the range of 0.62-0.68 mm, thus greatly reducing the length of the connector.

Figure 6:
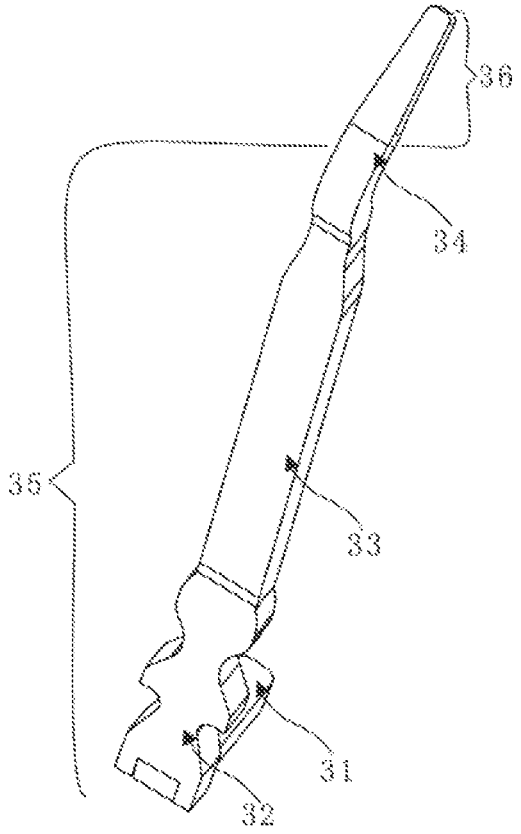
FIG. 6 is a perspective view of a signal terminal.

As shown in FIG. 6, the signal terminal 3 includes a terminal body 35, and a head end 36 connected as a whole with the terminal body 35. The thickness of the head end 36 is smaller than that of the terminal body 35. By improving the thickness of the signal terminal, the SI performance of the connector can be improved.

The two rows of signal terminals 3 are arranged in the plastic shell 1, and a PCB inserting groove is formed between the two rows of signal terminals 3. When using the connector, the PCB inserting groove is used for installing a PCB (printed circuit board) in a card inserting mode. One end, away from the head end 36, of the signal terminal 3 is connected to another PCB through a welding mode.

In one embodiment of the present invention, in order to facilitate assembly of the signal terminal 3 and the plastic housing 1, the two rows of signal terminals 3 can be arranged in a staggered manner and then placed into an injection mold. The plastic shell 1 is formed outside the signal terminal 3 by an injection molding mode. The plastic shell 1 and the signal terminal 3 are assembled together in this mode, then the signal terminals 3 can be avoided to be installed one by one, solving the problem of time-consuming installation.

Figure 1:
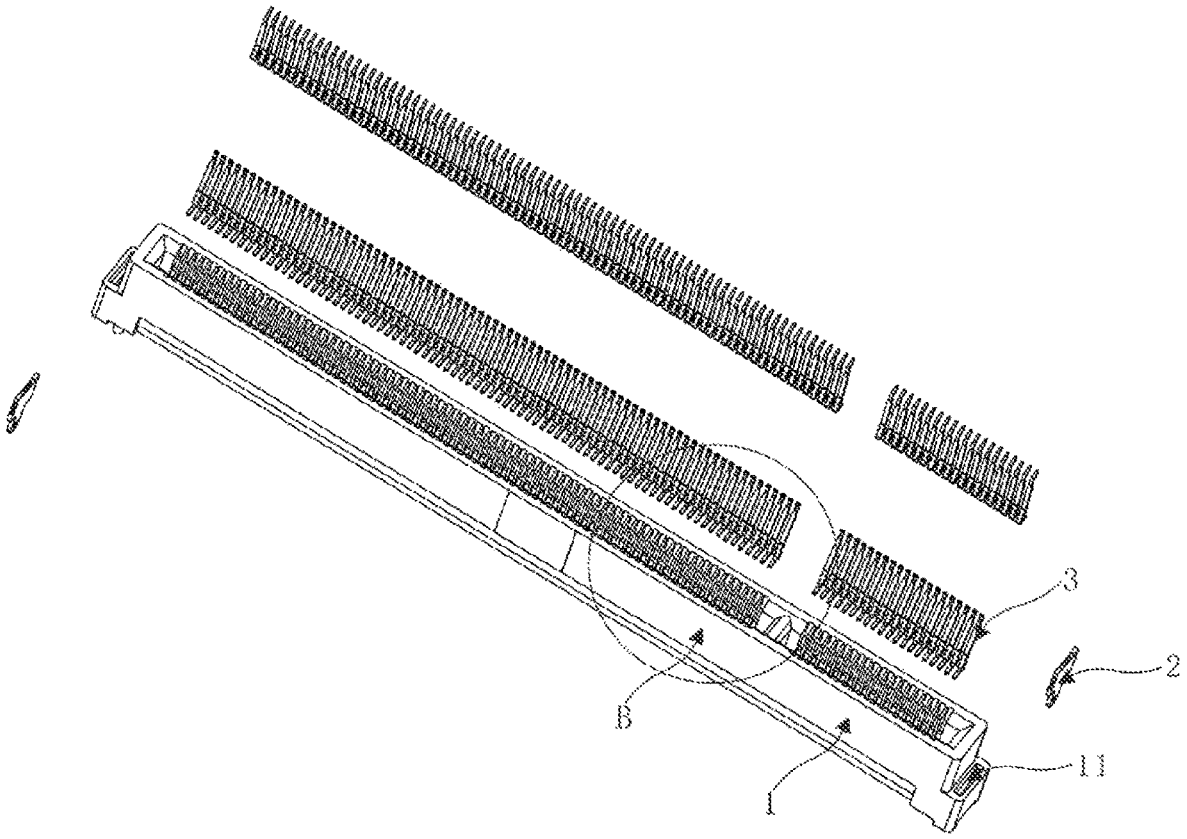
FIG. 1 is an exploded view of the miniaturization high-speed plug-in card type connector.
Figure 2:
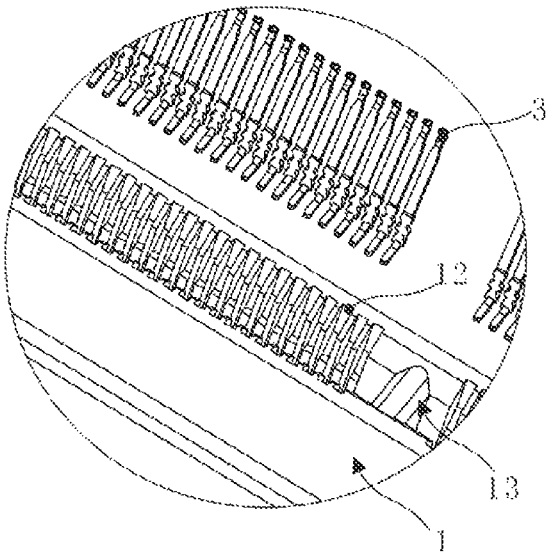
FIG. 2 is an enlarged view of part B.
Figure 3:
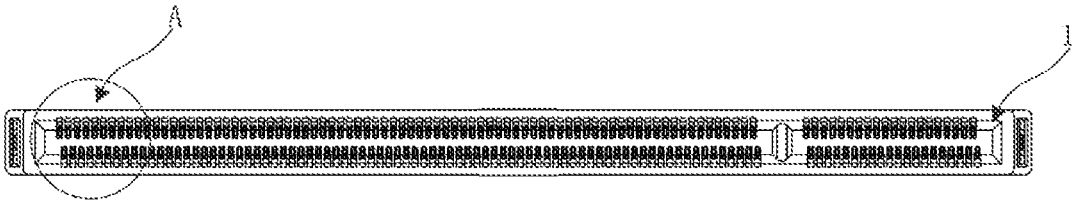
FIG. 3 is a top view of the miniaturized high-speed plug-in card type connector.
Figure 4:
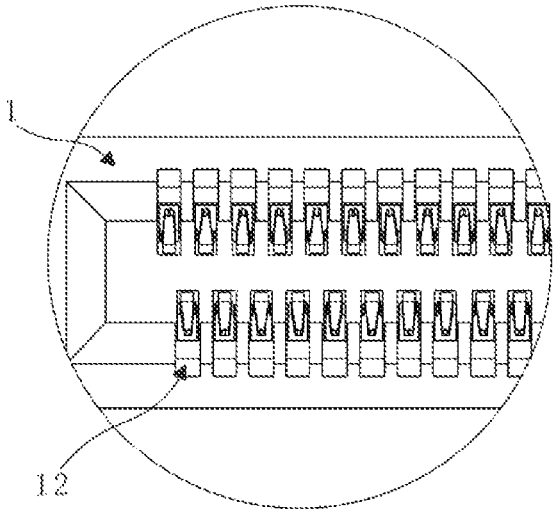
FIG. 4 is an enlarged view of part A.

Referring to FIG. 1, an exploded view of a miniaturized high-speed plug-in card type connector is shown in FIG. 1. FIG. 2 shows an enlarged view of the portion B in FIG. 1. As shown in FIG. 1 and FIG. 2, the plastic shell 1 is provided with a terminal clamping groove 12 extending through the bottom of the plastic shell 1. The signal terminals 3 are installed in the terminal clamping groove 12. The signal terminals are installed in this mode, even though the installation is time-consuming, once one signal terminal 3 is damaged, the replacement can be facilitated. In addition, the customer can install different types of signal terminals 3 according to needs.

As shown in FIG. 6, the terminal body 35 includes an extending portion 31, a connecting portion 32 (the arc-shaped grooves are respectively formed in the two sides of the connecting portion 32), a plane portion 33 and an arc-shaped portion 34, and the extending portion 31, the connecting portion 32, the plane portion 33 and the arc-shaped portion 34 are integrally connected. The extending portion 31 is located outside the terminal clamping groove 12, and an included angle is formed between the connecting portion 32 and the extending portion 31. That is to say, the extending portion 31 and the connecting portion 32 can be arranged in a substantially perpendicular manner. For example, a small space may be occupied when the device is installed in a range of 85 degrees to 95 degrees.

Figure 5:
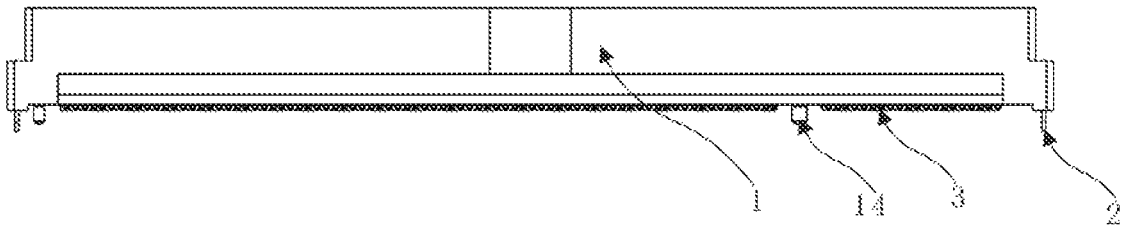
FIG. 5 is a front view of the miniaturized high-speed plug-in card type connector.

As shown in FIG. 5, to enable the extension part 31 to be tightly attached to the bottom of the plastic shell 1, after the signal terminals 3 are positioned on the plastic housing 1, so as to ensure the feasibility of miniaturization of the connector, in the technical solution, the connecting portion 32 is preferably perpendicular to the extending portion 31.

The arc-shaped portion 34 and the head end 36 are connected into a whole, so that an included angle is formed between the arc-shaped portion 34 and the head end 36. The distance between the two rows of opposite signal terminals 3 can be increased through this unique arrangement of the structure, and the crosstalk of the signals is further reduced. In addition, when the signal terminals 3 with this structure are adopted, then the original signals can still be transmitted while the volume of the signal terminals 3 is reduced, so that the length of the connector is further reduced.

As shown in FIG. 1 and FIG. 2, in an implementation, a connecting plate 13 which is fixedly connected to the side wall of the plastic shell 1, is arranged at the position, where the signal terminals 3 are not provided on the two sides of the PCB inserting groove. The strength of the plastic shell 1 can be increased with the arrangement of the connecting plate 13, so that the deformation of the long plastic shell 1 in use can be avoided.

Figure 7:
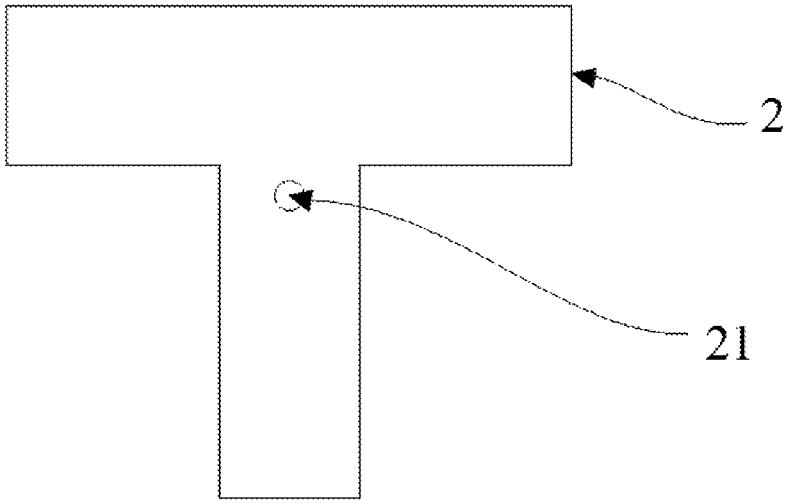
FIG. 7 is a front view of a fixing terminal.

In one embodiment of the present invention, a clamping groove 11 is formed in each of two ends of the plastic housing 11, and a fixing terminal 2 is clamped in the clamping groove 11. As shown in FIG. 1 and FIG. 5, the fixing terminal 2 and the clamping groove 11 are both T-shaped. As shown in FIG. 7, a connecting hole 21 is formed in the vertical plate of the fixed terminal 2, and the connecting hole 21 is located outside the clamping groove 11. Due to the arrangement of the connecting hole, the connector can be stably fixed on other components (such as a PCB). The connecting hole is preferably a round hole.

As shown in FIG. 5, in order to ensure that the connector is accurately installed on other components, at least one guide column 1414 can be arranged at the bottom of the plastic shell 11.

In conclusion, according to the technical solution, the position, the distance between the signal terminals 3, and the thickness of the head end 36 of the signal terminal 3 are uniquely arranged, normal signal transmission can still be guaranteed while the size of the connector is reduced.

We claim:

1. A miniaturized high-speed plug-in card type connector, comprising:

an elongate plastic shell having an interior groove with a bottom and opposite walls;

two rows of signal terminals arranged in the interior groove, wherein the two rows of signal terminals are arranged in a staggered manner, and at least one connecting plate is fixedly connected to the opposite walls and interposed between the rows of signal terminals, the at least one connecting plate is recessed in the interior groove so that the at least one connecting plate is not flush with a top surface of the opposite walls, and a distance between the two adjacent signal terminals in the same row is 0.62-0.68 mm, wherein each signal terminal includes a terminal body, the terminal body includes an extending portion, a connecting portion, a plane portion and an arc-shaped portion, the extending portion is horizontally extended from the connecting portion, arc-shaped grooves are respectively formed on two sides of the connecting portion, the arc-shaped grooves comprise two protrusions in each side of the connecting portion, and the arc-shaped grooves comprise a continuously curved shape between the two protrusions.

2. The miniaturized high-speed plug-in card type connector of claim 1, wherein the each signal terminal further includes a head end connected as a whole with the terminal body, and a thickness of the head end is smaller than a thickness of the terminal body.

3. The miniaturized high-speed plug-in card type connector of claim 2, wherein the extending portion, the connecting portion, the plane portion, and the arc-shaped portion are integrally connected, wherein the extending portion is located outside a terminal clamping groove, and an included angle is formed between the connecting portion and the extending portion.

4. The miniaturized high-speed plug-in card type connector of claim 3, wherein the connecting portion is substantially perpendicular to the extending portion.

5. The miniaturized high-speed plug-in card type connector of claim 3, wherein the included angle between the connecting portion and the extending portion is in a range of 85 degrees to 95 degrees.

6. The miniaturized high-speed plug-in card type connector of claim 1, wherein the elongate plastic shell is formed integrally with the two rows of signal terminals by an injection molding mode.

7. The miniaturized high-speed plug-in card type connector of claim 1, wherein the elongate plastic shell is provided with a terminal clamping groove extending through a bottom of the elongate plastic shell, and the signal terminals are installed in the terminal clamping groove.

8. The miniaturized high-speed plug-in card type connector of claim 1, wherein two ends of the elongate plastic shell are each provided with a clamping groove, and a fixing terminal is installed in the clamping groove.

9. The miniaturized high-speed plug-in card type connector of claim 8, wherein the fixing terminal and the clamping groove are both T-shaped, wherein a connecting hole is formed in a vertical plate of the fixing terminal, and the connecting hole is located outside the clamping groove.

* * * * *